US005148593A

United States Patent [19]

Walter

[11] Patent Number: 5,148,593

[45] Date of Patent: Sep. 22, 1992

[54] METHOD FOR JOINTING A DIELECTRIC WAVEGUIDE

[75] Inventor: Jeffrey A. Walter, Newark, Del.

[73] Assignee: W. L. Gore & Associates, Inc., Newark, Del.

[21] Appl. No.: 739,256

[22] Filed: Aug. 1, 1991

[51] Int. Cl.[5] ..... H01P 11/00

[52] U.S. Cl. ..... 29/600; 174/21 CA; 174/21 JS; 174/75 C; 174/84 C; 174/102 D; 385/50; 385/60; 385/98

[58] Field of Search ..... 29/600; 174/21 CA, 21 JR, 174/21 JS, 102 D, 84 S, 84 C, 75 C, 75 F; 385/50, 52, 60, 98, 72, 99

[56] References Cited

U.S. PATENT DOCUMENTS 3,936,145 2/1976 McCartney ..... 385/58
4,146,299 3/1979 Wellington et al. ..... 385/98 X
4,174,882 11/1979 McCartney ..... 385/72 X

*Primary Examiner*—Carl J. Arbes
*Attorney, Agent, or Firm*—E. Alan Uebler

[57] ABSTRACT

The invention provides a method for precisely joining two sections of dielectric waveguides to form a waveguide joint, wherein such waveguides comprise a dielectric core, preferably of polytetrafluoroethylene (PTFE), one or more layers of dielectric cladding, preferably of PTFE, wrapped around the core, and one or more shielding layers wrapped around the cladding. A precise joint is provided wherein the two joined sections of waveguide are precisely oriented axially, radially and rotationally with respect to each other.

7 Claims, 2 Drawing Sheets

METHOD FOR JOINTING A DIELECTRIC WAVEGUIDE

BACKGROUND OF THE INVENTION

This invention relates to dielectric waveguides for the transmission of electromagnetic waves wherein such waveguides comprise a dielectric core, one or more layers of dielectric cladding wrapped around the core, and one or more shielding layers wrapped around the cladding. The core and cladding preferably are polytetrafluoroethylene (PTFE), such as disclosed in U.S. Pat. No. 4,463,329. These waveguides may be fractions of an inch in diameter up to several inches in diameter. More specifically, the invention relates to a method for forming a precise joint between two sections of such a dielectric waveguide. A substantially precise joint is provided wherein the two joined sections of waveguide are precisely oriented axially, radially and rotationally with respect to each other. A technique is provided for joining two or more sections of the same dielectric waveguide with substantially no deterioration of insertion and return loss characteristics.

There are three basic reasons for being able to accurately join sections of such waveguides. A dielectric waveguide assembly may be damaged in the field due to an act of war or any other accident necessitating its repair. Second, there may be situations, particularly in cases of long assemblies, where it is not practical to feed the complete assembly from one end. In such a case, an assembly may be built and installed in suitable, shorter length sections. Third, various standard length sections with standard end couplings may be stocked so that a required length of assembly can quickly be built to meet preselected length requirements.

For a joint which has almost no insertion loss and which does not cause any appreciable reflection of electromagnetic waves, two requirements must be met. Two ends of the dielectric waveguide to be joined must be precisely cut so that they are flat and perpendicular to the axis of the dielectric waveguide to provide that, when the cut ends are brought together to form a joint, there is no air gap between them. Second, the center cores of the two sections must be in perfect angular, radial and axial alignment with respect to each other.

This invention provides a technique for producing precision joints between sections of such waveguides.

SUMMARY OF THE INVENTION

A method of making a joint between two sections of a dielectric waveguide is provided wherein the dielectric waveguide comprises a dielectric core having a non-circular cross-section, one or more layers of dielectric cladding wrapped around the core, and one or more shielding layers wrapped around the cladding. The waveguide may be further covered with an outer jacket. The core and cladding preferably are of polytetrafluoroethylene (PTFE), but other dielectric materials may be employed.

The method comprises first cutting one end of one of the dielectric waveguide sections to be jointed in a precise, transverse cut perpendicular to the long axis of the waveguide. A flanged coupling and an aluminum alignment tool are then joined together, wherein the flanged coupling has, at its proximal end thereof, means for clamping and gripping the one end of the waveguide, the coupling having, at its distal end, a flange having a plurality of precision alignment openings therethrough, the coupling having a longitudinal opening through the center thereof to permit passage therethrough of the one end of the waveguide. The aluminum alignment tool has a plurality of precision openings therein in registry with the openings in the flange and the flanged coupling and alignment tool are joined in precise alignment by fastening means extending through the precision openings. The alignment tool has a longitudinal opening therethrough whose cross-section corresponds to the cross-section of the dielectric core. A portion of the cladding and shielding layers are stripped away from the dielectric waveguide at the one end thereof to expose a length of the core, the exposed length being greater than the longitudinal dimension of the alignment tool, and the one end of the waveguide with exposed core is inserted into and through the flanged coupling and attached alignment tool such that the exposed core extends into and through the longitudinal opening in the alignment tool, the corresponding cross-sections of the core and the opening in said alignment tool thereby being in precise radial alignment with respect to each other. The coupling is clamped at its proximal end to the dielectric waveguide by the clamping means while retaining precision alignment of the core and corresponding opening in the alignment tool, and the aluminum alignment tool is then removed from the flanged coupling. A shim-lapping tool is affixed to the flanged coupling, the shim-lapping tool having a central longitudinal opening therethrough whose cross-section corresponds to the cross-section of the waveguide, the one end of the waveguide extending therethrough. The longitudinal dimension of the shim-lapping tool is preferably less than 0.025 inch. The end of the waveguide is precisely cut transversely, adjacent to and with the aid of the shim-lapping tool, to form a precision transverse cut across the end of the waveguide, the length of the waveguide, as a result of the cutting which extends outwardly from the flange, thereby being less than 0.025 inch. The shim-lapping tool is removed. The above steps of cutting-through-removing are repeated for the other of the two sections of the waveguide to be jointed, and the two so-prepared ends of the waveguide are affixed together, with their respective flanged couplings, such that the waveguide sections are in precise axial, radial and rotational alignment with respect to each other.

The longitudinal dimension of the shim-lapping tool is preferably 0.015 inch, and the length of the waveguide extending outwardly from the flange is then 0.015 inch. The cross-section of the dielectric core may be rectangular or it may be square. The method may include inserting, between the two flanged couplings, a washer-like gasket comprising porous, expanded polytetrafluoroethylene.

DETAILED DESCRIPTION OF THE INVENTION AND PREFERRED EMBODIMENTS WITH REFERENCE TO THE DRAWINGS

The invention provides a method for precisely joining two sections of dielectric waveguides to form a waveguide joint, wherein such waveguides comprise a dielectric core, one or more layers of dielectric cladding wrapped around the core and one or more shielding layers wrapped around the cladding. An outer jacket may be employed. The core and cladding preferably are PTFE. A precise joint is provided wherein the two joined sections of waveguide are precisely oriented axially, radially and rotationally with respect to each other.

Figure 1:
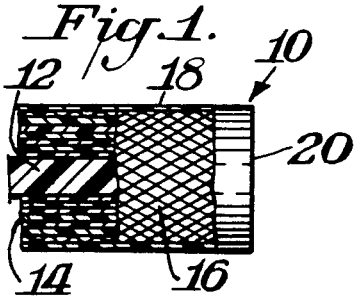
FIG. 1 is a side-elevational view, partly broken away and in cross-section, of one end of one waveguide to be jointed according to the invention.

A detailed description of the invention and preferred embodiments is best provided by reference to the accompanying drawings wherein FIG. 1 shows a side-elevational view, partly in cross-section, of one end of one waveguide 10 to be jointed. The waveguide 10 comprises core 12, which may be PTFE, which is overwrapped by layers 14, preferably of PTFE, and is covered with shielding layer 16. An outer jacket 18 may be employed which may be polyester braid, heat-shrink tubing or any material which meets the environmental requirements of the application. A precision cut 20 is first made transversely across the waveguide end 10 and the outer jackets 16 and 18, and a portion of the cladding 14 is stripped away as shown in FIG. 2.

Figure 2:
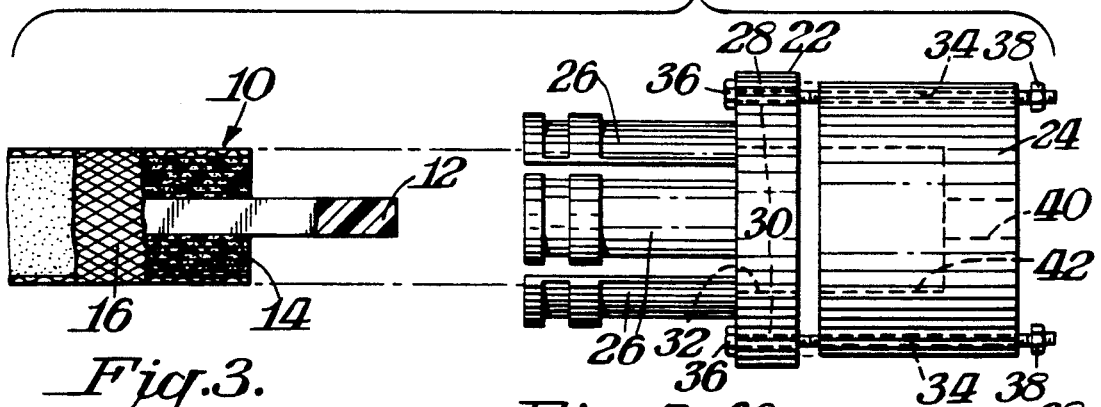
FIG. 2 is an exploded side elevation, partly in cross-section, of the one end of one waveguide shown in FIG. 1, partially stripped away, just prior to insertion thereof into a flanged coupling member with an about-to-be-attached aluminum alignment tool.

FIG. 2 shows an exploded side elevational view of the partially stripped waveguide end 10 showing exposed central core 12 Flanged coupling 22 has flange 28 and clamping finger means 26 which will permit the flanged coupling 22 to be clamped to the prepared end of waveguide 10.

The flanged coupling 22 has a central longitudinal opening 32 therethrough to enable waveguide to pass through. Alignment tool 24 is shown about to be tightened onto coupling flange 22 by fastening means 36 (bolts) and 38 (nuts). Precision openings 30 in flange 28 are in register with precision openings 34 in alignment tool 24. Opening 40 in alignment tool 24 has substantially the identical cross-section of core 12, and opening 42 in the alignment tool 24 has approximately the cross-section of the outermost cladding wrap 14.

Figure 3:
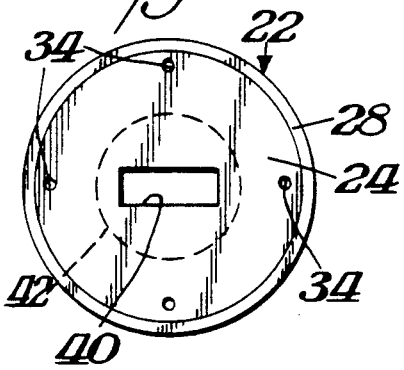
FIG. 3 is an end elevation of the aluminum alignment tool.

FIG. 3 shows an end elevation of the alignment tool 24 with the bolts 36 and nuts 38 removed for clarity. The alignment tool 24, which preferably is aluminum, has precision openings 34 which align with similar openings 30 in flanged coupling 22. The opening 40 in alignment tool 24 has substantially the same cross-section as core 12 of waveguide 10, as shown.

Flanged coupling 22 is preferably made of a suitable metal or plastic such as Delrin® polycarbonate.

Figure 4:
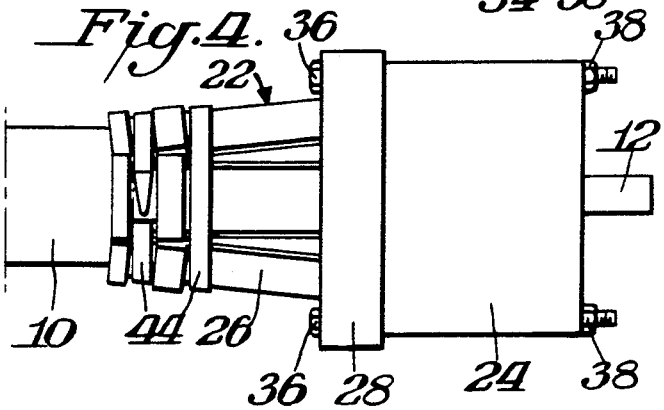
FIG. 4 is a side elevation of one end of the waveguide inserted into the flanged coupling member and clamped in place thereat, the coupling member having the alignment tool affixed thereto, which provides aligning guidance for insertion of the waveguide end prior to clamping of the waveguide to the coupling member.

FIG. 4 shows the flanged coupling 22 fastened to alignment tool 24 by means of bolts 36 and nuts 38. Waveguide 10, stripped as shown in FIG. 2, is inserted through the coupling 22 and into tool 24 so that the core 12 extends through opening 40 and thereby creates a precision alignment with respect to the rotational dimension of the waveguide 10 and coupling flange 22. Clamps 44 are then tightened around finger-like clamping means 26 thereby affixing the waveguide 10 and coupling member 22 together. The alignment tool 24 is then removed by taking off bolts 36 and nuts 38.

Figure 5:
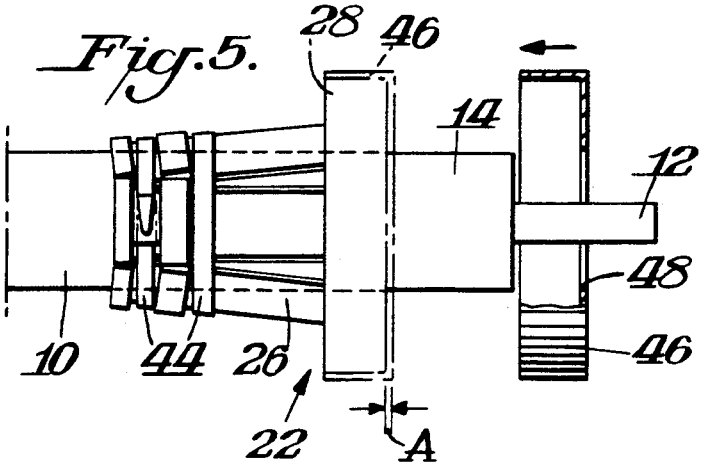
FIG. 5 shows the waveguide end clamped to the coupling member, after removal of the alignment tool, and just prior to placement of a shim-lapping tool over the flange of the flanged coupling member.

FIG. 5 shows the waveguide 10 and affixed coupling flange 22 and, in addition, a shim-lapping tool 46 being positioned over flange 28. The shim-lapping tool 46 is cap-like in shape and has longitudinal opening 48 therein. The diameter of opening 48 is substantially the same as the outer diameter of the outermost wrap of cladding 14. The shim-lapping tool 46 is slipped over flange 28, as shown in phantom, and this tool provides a hard, flat cutting surface for lapping off the unneeded section of waveguide that protrudes beyond the flange. The wall thickness of the shim-lapping tool 46, "A" in FIG. 5, determines the length of the waveguide 10 which protrudes outwardly from flange 28. This thickness "A" is normally less than 0.025 inch, and is preferably about 0.015 inch.

Figure 6:
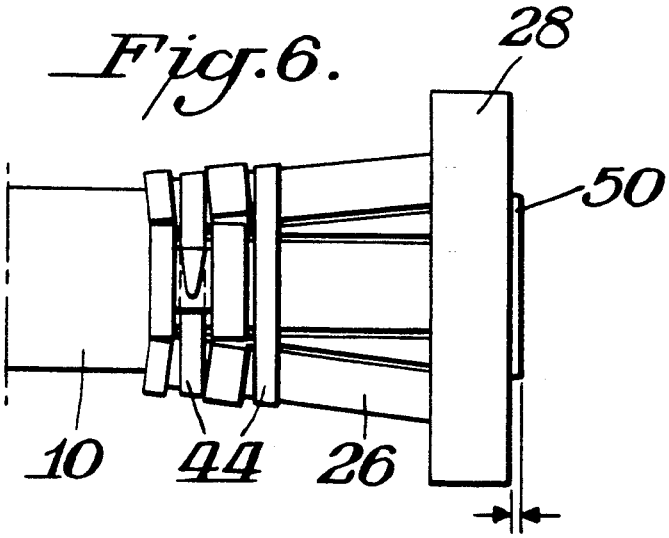
FIG. 6 shows a side elevation of one completed end of a waveguide to be joined to another end of waveguide.

The completed one end of spliced waveguide is shown in FIG. 6. After cutting off the unneeded portion, the protrusion 50 of the waveguide extends outwardly from flange 28 by "A" inches.

Figure 7:
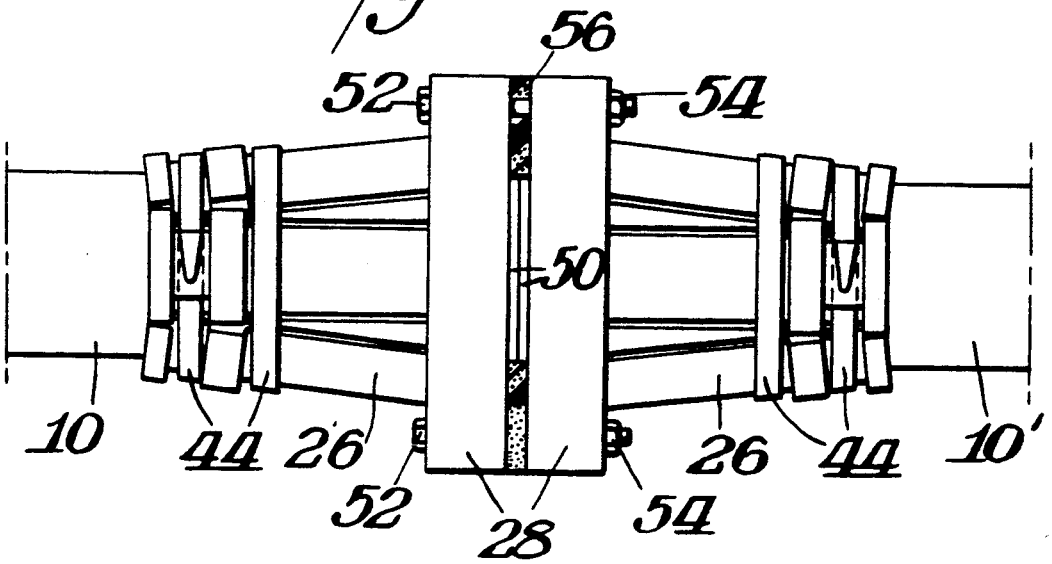
FIG. 7 shows a preferred, completed waveguide joint.

To form a complete splice, the above process is repeated on the second end of waveguide 10' and the two ends are fastened together as shown in FIG. 7, by means of bolts 52 and nuts 54, for example. Because of the protrusions 50 of the waveguides 10 outwardly from the flanges 28, when bolts 52 are fully tightened, the two projecting ends 50 compress together leaving no air gap at the interface between the adjacent waveguide ends.

Once the elements according to the invention are assembled, potting compound (conductive or non-conductive) may be filled in the gaps around the waveguide 10, in the flange slots and over the metal or plastic clamping bands 26.

Since both flanges are symmetrical and the center cores of both dielectric waveguides have been fully aligned with flanges 28, the center cores of both waveguides will be in substantially perfect angular, axial and rotational alignment with each other when the two flanges are attached.

The nuts and bolts may be sealed with potting compound, and copper or aluminum shielding foil or tape may be wrapped over the flanges. Grooves for "O" ring seals may also be provided on mating faces of the strain relief flanged couplings to provide a moisture barrier. A heat-shrink tube may be shrink-fitted over the entire joint to protect it from the environment. If used, the tube should be placed over one end before attaching the two flanged couplings together.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A method for making a joint between two sections of a dielectric waveguide, wherein said dielectric waveguide comprises a dielectric core having a non-circular cross-section, one or more layers of dielectric cladding wrapped around said core, and one or more shielding layers wrapped around said cladding, said method comprising:

(a) cutting one end of one of said dielectric waveguide sections to be jointed in a precise transverse cut perpendicular to the long axis of said waveguide, (b) joining together a flanged coupling and an aluminum alignment tool, wherein said flanged coupling has, at its proximal end thereof, means for clamping and gripping said one end of said waveguide, said coupling having, at its distal end, a flange having a plurality of precision alignment openings therethrough, the coupling having a longitudinal opening through the center thereof to permit passage therethrough of said one end of said waveguide, said aluminum alignment tool having a plurality of precision openings therein in registry with said openings in said flange, said coupling and alignment tool being joined in precise alignment by fastening means extending through said precision openings, said alignment tool having a longitudinal opening therethrough whose cross-section corresponds to the cross-section of said dielectric core, (c) stripping away from said dielectric waveguide at said one end thereof a portion of said cladding and shielding layers to expose a length of said core, said length being greater than the longitudinal dimension of said alignment tool, (d) inserting said one end of said waveguide with exposed core into and through said flanged coupling and attached alignment tool such that said exposed core extends into and through the longitudinal opening in said alignment tool, the corresponding cross-sections of said core and said opening in said alignment tool thereby being in precise radial alignment with respect to each other, (e) clamping said coupling at its proximal end to said dielectric waveguide by said clamping means while retaining precision alignment of said core and corresponding opening in said alignment tool, (f) removing said aluminum alignment tool from said flanged coupling, (g) affixing a shim-lapping tool to said flanged coupling, said shim-lapping tool having a central longitudinal opening therethrough whose cross-section corresponds to the cross-section of said waveguide, said one end of said waveguide extending therethrough, the longitudinal dimension of said shim-lapping tool being less than 0.025 inch, (h) precisely cutting said one end of said waveguide transversely, adjacent to and with the aid of said shim-lapping tool, to form a precision transverse cut across said one end of said waveguide, the length of said waveguide extending outwardly from said flange thereby being less than 0.025 inch, (i) removing said shim-lapping tool, (j) repeating steps (a) through (i) for the other of said two sections of said waveguide to be jointed, and (k) affixing the two so-prepared ends of said waveguide together, with their respective flanged couplings, such that said waveguide sections are in precise axial, radial and rotational alignment with respect to each other.

2. The method of claim 1 wherein the longitudinal dimension of said shim-lapping tool is 0.015 inch and the length of said waveguide extending outwardly from said flange thereby being 0.015 inch.

3. The method of claim 1 wherein the cross-section of said dielectric core is rectangular.

4. The method of claim 1 wherein the cross-section of said dielectric core is square.

5. The method of claim 1 including, between steps (j) and (k), inserting between said two flanged couplings a washer-like gasket comprising porous, expanded polytetrafluoroethylene.

6. The method of claim 1 wherein said core and cladding are polytetrafluoroethylene.

7. The method of claim 6 wherein said cladding is porous, expanded polytetrafluoroethylene.

* * * * *